US012605028B2

(12) United States Patent
Sloboda et al.

(10) Patent No.: US 12,605,028 B2
(45) Date of Patent: Apr. 21, 2026

(54) SUCTION NOZZLE FOR EXTRACTION CLEANER

(71) Applicant: BISSELL Inc., Grand Rapids, MI (US)

(72) Inventors: Mitch Sloboda, Sparta, MI (US); Victoria J. Royale, Comstock Park, MI (US)

(73) Assignee: BISSELL, Inc., Grand Rapids, MI (US)

( * ) Notice: Subject to any disclaimer, the term of this patent is extended or adjusted under 35 U.S.C. 154(b) by 385 days.

(21) Appl. No.: 18/206,344

(22) Filed: Jun. 6, 2023

(65) Prior Publication Data

US 2023/0389767 A1 Dec. 7, 2023

Related U.S. Application Data

(60) Provisional application No. 63/349,784, filed on Jun. 7, 2022.

(51) Int. Cl.

| | |
|---|---|
| ***A47L 11/40*** | (2006.01) |
| ***A47L 11/30*** | (2006.01) |
| ***A47L 11/34*** | (2006.01) |

(52) U.S. Cl.

CPC ..... *A47L 11/4044* (2013.01); *A47L 11/30* (2013.01); *A47L 11/34* (2013.01); *A47L 11/4088* (2013.01)

(58) Field of Classification Search

CPC ..... A47L 11/4044; A47L 11/30; A47L 11/34; A47L 11/4088

See application file for complete search history.

(56) References Cited

U.S. PATENT DOCUMENTS

| | | | | |
|---|---|---|---|---|
| 3,866,264 | A | 2/1975 | Engquist | |
| 6,775,880 | B2 | 8/2004 | Kasper et al. | |
| 6,938,838 | B2 * | 9/2005 | Kawamoto | A47L 11/34 239/509 |
| 8,429,788 | B1 | 4/2013 | Lovelady et al. | |
| 10,105,024 | B2 | 10/2018 | Kasper | |
| 10,667,660 | B2 | 6/2020 | McIntosh et al. | |
| 2004/0177469 | A1 * | 9/2004 | Sadaune | B08B 1/12 15/322 |
| 2007/0107159 | A1 * | 5/2007 | Kawamoto | B08B 3/026 15/322 |
| 2016/0100725 | A1 | 4/2016 | Janssen, Jr. | |
| 2018/0110201 | A1 * | 4/2018 | Mohyer, Jr. | A47L 11/4044 |

FOREIGN PATENT DOCUMENTS

| | | | |
|---|---|---|---|
| CN | 2728400 | Y | 9/2005 |
| DE | 102016115576 | A1 | 3/2018 |
| DK | 51578 | C | 4/1936 |

(Continued)

*Primary Examiner* — Ryan J. Walters
(74) *Attorney, Agent, or Firm* — Price Heneveld LLP

(57) ABSTRACT

A suction nozzle for use with an extraction cleaner having a suction source includes a tool body and a front cover connected to the tool body. The tool body includes a rear wall. The tool body defines an exhaust port configured to connect to the suction source. The front cover and the rear wall together define an extraction nozzle volume having a suction inlet. The tool body defines a pair of air vents situated above the suction inlet. The front cover has a pair of side walls. In some embodiments, lateral edges of the side walls adjacent to the suction inlet define an arcuate notch for introducing a slipstream into the extraction nozzle volume.

18 Claims, 7 Drawing Sheets

(56) References Cited

FOREIGN PATENT DOCUMENTS

| | | | | | |
|---|---|---|---|---|---|
| EP | 3315023 | A1 | | 3/2022 | |
| GB | 2005992 | B | | 3/1982 | |
| JP | H11137487 | A | | 5/1999 | |
| JP | 2001070207 | A | | 3/2001 | |
| JP | 2017124129 | A | * | 7/2017 | ..... A47L 9/02 |

* cited by examiner

SUCTION NOZZLE FOR EXTRACTION CLEANER

CROSS-REFERENCE TO RELATED APPLICATION

This application claims priority to and the benefit under 35 U.S.C. § 119(e) of U.S. Provisional Application No. 63/349,784, filed on Jun. 7, 2022, entitled "SUCTION NOZZLE FOR EXTRACTION CLEANER," the disclosure of which is hereby incorporated herein by reference in its entirety.

BACKGROUND

The subject disclosure pertains to extraction cleaners of a type commonly used to clean rugs, carpeted floors, and upholstered surfaces. In particular, the subject disclosure pertains to an improved extraction tool that is usable in conjunction with an upright, handheld, or portable extraction cleaner having a suction source and an accompanying nozzle volume through which fluid and debris is ultimately extracted from the surface during such an extraction cleaning process.

As appreciated in the art, fluid-based or "wet" extraction cleaners typically include a fluid supply tank containing cleaning fluid having an application-suitable composition. For instance, common household extraction cleaning tasks can often be performed using a water-based cleaning solution containing surfactants, stabilizers, fragrances, and other active and inactive ingredients. The cleaning fluid is dispensed from the fluid supply tank onto a surface to be cleaned, e.g., through one or more orifices of an accompanying extraction tool or using an external spray nozzle. The dispensed cleaning fluid can be agitated to capture embedded dirt, pet dander, and other debris. The suction source located aboard the extraction cleaner generates strong suction forces, which are used to extract fluid and debris from the surface. The extracted fluid and debris is deposited into a removable recovery tank for easy disposal.

SUMMARY

A suction nozzle is disclosed herein for use with an extraction cleaner, i.e., a fluid-based cleaning device having an onboard suction source such as a motor/impeller system that is operable for extracting fluid and debris from a surface. The contemplated suction nozzle in its various configurations can be an integral component of a handheld/portable extraction cleaner, or the suction nozzle can be a hose-connectable tool attachment or accessory. When viewed from its front-facing surface, the suction nozzle in some embodiments may have a generally hemispherical perimeter shape as exemplified herein, or the perimeter shape may be generally trapezoidal or triangular, e.g., with linear as opposed to curvilinear lateral surfaces to help minimize internal turbulence.

As noted above, wet-type extraction cleaners enable a user to extract dirt and debris from a surface. Carpeting, rugs, and upholstered surfaces are representative surfaces often cleaned in this manner. Such surfaces tend to be soft, and thus yielding and resilient relative, e.g., to hardwood floors. As a result, suction forces presented at a suction inlet, absent the present improvements, can at times draw a portion of the surface into the suction inlet. This in turn can weaken or disperse flow fields ("extraction flow") of the extracted fluid and entrained debris within a defined nozzle volume of the suction nozzle.

For example, non-vented suction nozzles constructed in accordance with the current state of the art may tend to produce highly distributed internal flow fields, turbulence, edge or corner vortices, and other undesirable fluid dynamics, which reduces the fluid recovery rate in terms of fluid recovery-per-cleaning stroke. In addition, conventional extraction tools lacking the vents of the present disclosure can often experience restricted airflow during use when the surface forms a "seal" with the nozzle inlet, which may also reduce the fluid recovery rate. Such restricted air flow may occur when the tool is being used with compliant surfaces, e.g., drapes, and the surface is drawn into the nozzle inlet and/or when the user presses the tool against a surface such that a majority of a perimeter of the nozzle inlet directly abuts the surface. Thus, the suction nozzle contemplated herein is directed toward optimizing flow properties and overall cleaning efficiency during an extraction cleaning process, with an eye toward improving overall fluid recovery.

To that end, a representative embodiment of the suction nozzle for use with an extraction cleaner includes a tool body having a rear wall. The tool body defines an exhaust port, i.e., an opening through which extracted fluid and debris is expelled from the suction nozzle. The exhaust port connects to a suction source of the extraction cleaner, e.g., one or more single-stage or multi-stage motorized vacuum pumps. Fluid and debris extracted in this manner is ultimately collected in a removable recovery tank for disposal, as noted above. A front cover, also referred to herein as a lens when the front cover is constructed of a transparent material, may be removably connected to the tool body, for instance using a snap-fit perimeter connection, tongue-and-groove or another suitable perimeter seal, and/or a latching mechanism.

The front cover and the rear wall may together define an extraction nozzle volume having a suction inlet. As appreciated in the art, the suction inlet may be elongated in some implementations and supported by one or more transverse ribs. In such a construction, the suction inlet can be formed from multiple suction inlet segments arranged end-to-end. For simplicity, the singular term "suction inlet" is used herein to describe the collective set of such segments regardless of number, as well as a single suction inlet without limitation. In some aspects of the present disclosure, the suction inlet may have a generally rectangular perimeter, and may also span a width of the aforementioned tool body, without precluding other perimeter shapes.

Within the scope of the present disclosure, the tool body in some configurations defines an oppositely-disposed pair of air vents situated a predetermined distance above the suction inlet, e.g., within about 2 inches (about 50.8 mm) of the suction inlet as measured from the suction inlet to an intersection of a respective center axes of the air vents and a plane defined by the rear wall. Various example distances falling within this range are set forth in detail herein.

According to an exemplary implementation, the suction nozzle has a width of about 3 inches to about 6 inches (76.2 mm to 152.4 mm). The actual distance between the air vents and the suction inlet may vary with the size and construction of the suction nozzle. In some aspects, the contemplated air vents are positioned adjacent to a lateral edge of the body, such as within about 0.4 inches to about 0.8 inches (10.16 mm to 20.32 mm) or less than about 1 inch (25.4 mm) of each respective lateral edge, as measured from the lateral edge to the nearest edge of the respective air vents. Various exemplary distances falling within this range are set forth in detail below.

According to one exemplary aspect, the air vents are placed as close to the lateral edges of the suction nozzle as possible in light of physical limitations imposed by the shape, curvature, and thickness of the body thereof. While the air vents are described as being symmetrically located on the body, i.e., oppositely disposed and equidistant from a centerline of the body, it is understood that the relative location of each air vent may be different such that the air vents are asymmetrically located relative to such a centerline, such that one vent is closer to the centerline than the other.

The rear wall may have a downstream section disposed at a first angle relative to the surface, such that the rear surface tilts backward toward a user in a typical use scenario. The center axes of the air vents are then arranged at a second angle such that the respective center axes of the air vents intersect the rear wall at a non-orthogonal angle. For instance, the second angle may be arranged between about 30° to about 45° of the rear wall in a possible implementation. Such an orientation is intended to minimize turbulence when inlet airflow passing through the air vents mixes and blends with the extraction flow passing through the extraction nozzle volume.

The front cover may be optionally constructed of a transparent material such as clear or frosted/tinted plastic, in which case the front cover forms a lens. Such a lens would enable a user to view the extracted fluid and entrained debris as it is being extracted from the surface. Alternatively, the front cover may be constructed from an opaque material.

Optionally, the front cover or lens may be removeable for cleaning. In embodiments utilizing the lens, the air vents may be present in the rear wall of the tool body to provide a clearer view through the lens of the flow fields within the extraction nozzle volume, thus allowing a user to perceive at a glance that the ongoing extraction cleaning process is working effectively. While the air vents are described in the context of being disposed in the rear wall of the tool body for illustrative consistency below, it is within the scope of the present disclosure for the air vents to be provided in the front cover or lens in other embodiments.

An aspect of the present disclosure includes a respective perimeter of each of the air vents being tapered. For example, the perimeter, i.e., the outer/surrounding shape of the air vent where the air vents opens to an interfacing surface of the rear wall, could have an ovoid, elliptical, or oblong shape. Without being limited by any theory, it is believed that such configurations would help smooth the transition of intake air flowing through the air vents into the extraction flow as noted above.

The front cover in a possible implementation includes a pair of side walls each having a lower edge adjacent to and flanking the suction inlet. The side walls in such an implementation may define a respective arcuate notch along the lower edge, e.g., at an approximate or exact center thereof. The tool body may optionally include an agitator assembly. Such an agitator assembly may be disposed adjacent to the suction inlet. In a possible construction, a conduit section defines a fluid passage in fluid communication with the above-summarized exhaust port, with the conduit section being configured to connect to the extraction cleaner. In this manner, the suction source and other components of the extraction cleaner are fluidly coupled to the disclosed suction nozzle.

Another aspect of the disclosure includes an extraction cleaner having a housing, a suction source connected to the housing, and a suction nozzle. The suction nozzle in this particular configuration includes a tool body having a rear wall. An exhaust port is defined by the tool body. The exhaust port is connected to the suction source. The tool body also includes a front cover connected to the rear wall such that the front cover and the rear wall together define an extraction nozzle volume having a suction inlet. The rear wall defines an oppositely-disposed pair of air vents situated at a height above the suction inlet, with each respective one of the air vents having a respective center axis that intersects the rear wall at a non-orthogonal angle as described below.

In yet another aspect of the disclosure, a suction nozzle for use with an extraction cleaner having a suction source includes a tool body having a rear wall. The tool body defines an exhaust port. The exhaust port being configured to connect to the suction source. The tool body also includes an agitator assembly and a front cover connected to the body. The front cover also includes a pair of side walls. A lower edge of each side wall of the pair of side walls defines an arcuate notch. In this exemplary configuration, the front cover and the rear wall together define an extraction nozzle volume having a suction inlet. The agitator assembly is disposed adjacent to the suction inlet. The arcuate notch is configured to admit a slipstream into the extraction nozzle volume. Moreover, the rear wall defines a pair of air vents having respective center axes that intersect the rear wall at a non-orthogonal angle.

The above summary is not intended to represent every possible construction or aspect of the subject disclosure. Rather, the foregoing summary is intended to exemplify some of the novel aspects and features disclosed herein. The above-summarized features and other features and advantages of the subject disclosure will be readily apparent from the following detailed description of representative embodiments and modes for carrying out the subject disclosure when taken in connection with the accompanying drawings and the appended claims.

BRIEF DESCRIPTION OF THE DRAWINGS

The drawings described herein are for illustrative purposes only, are schematic in nature, and are intended to be exemplary rather than to limit the scope of the disclosure.

The appended drawings are not necessarily to scale, and may present a somewhat simplified representation of various preferred features of the present disclosure as disclosed herein, including, for example, specific dimensions, orientations, locations, and shapes. Details associated with such features will be determined in part by the particular intended application and use environment.

DETAILED DESCRIPTION

The subject disclosure may be embodied in many different forms. Representative examples are shown in the various drawings and described in detail below, with the understanding that the descriptions are exemplifications of the disclosed principles and not limitations of the broad aspects of the disclosure. To that end, elements and limitations described below, but not explicitly set forth in the claims, should not be incorporated into the claims, singly or collectively, by implication, inference, or otherwise. Moreover, the drawings discussed herein may not be to scale, and are provided purely for instructional purposes. Thus, the specific and relative dimensions shown in the Figures are not to be construed as limiting.

Additionally, unless specifically disclaimed: the singular includes the plural and vice versa; the words "and" and "or" shall be both conjunctive and disjunctive; the words "any" and "all" shall both mean "any and all"; and the words "including," "containing," "comprising," "having," along with permutations thereof and similar terms, shall each mean "including without limitation." Further, the words "example" or "exemplary" are used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion. Moreover, words of approximation, such as "about," "almost," "substantially," "generally," "approximately," and the like, may each be used herein in the sense of "at, near, or nearly at," or "within 0-5% of," or "within acceptable manufacturing tolerances," or any logical combination thereof, for example.

Figure 1:
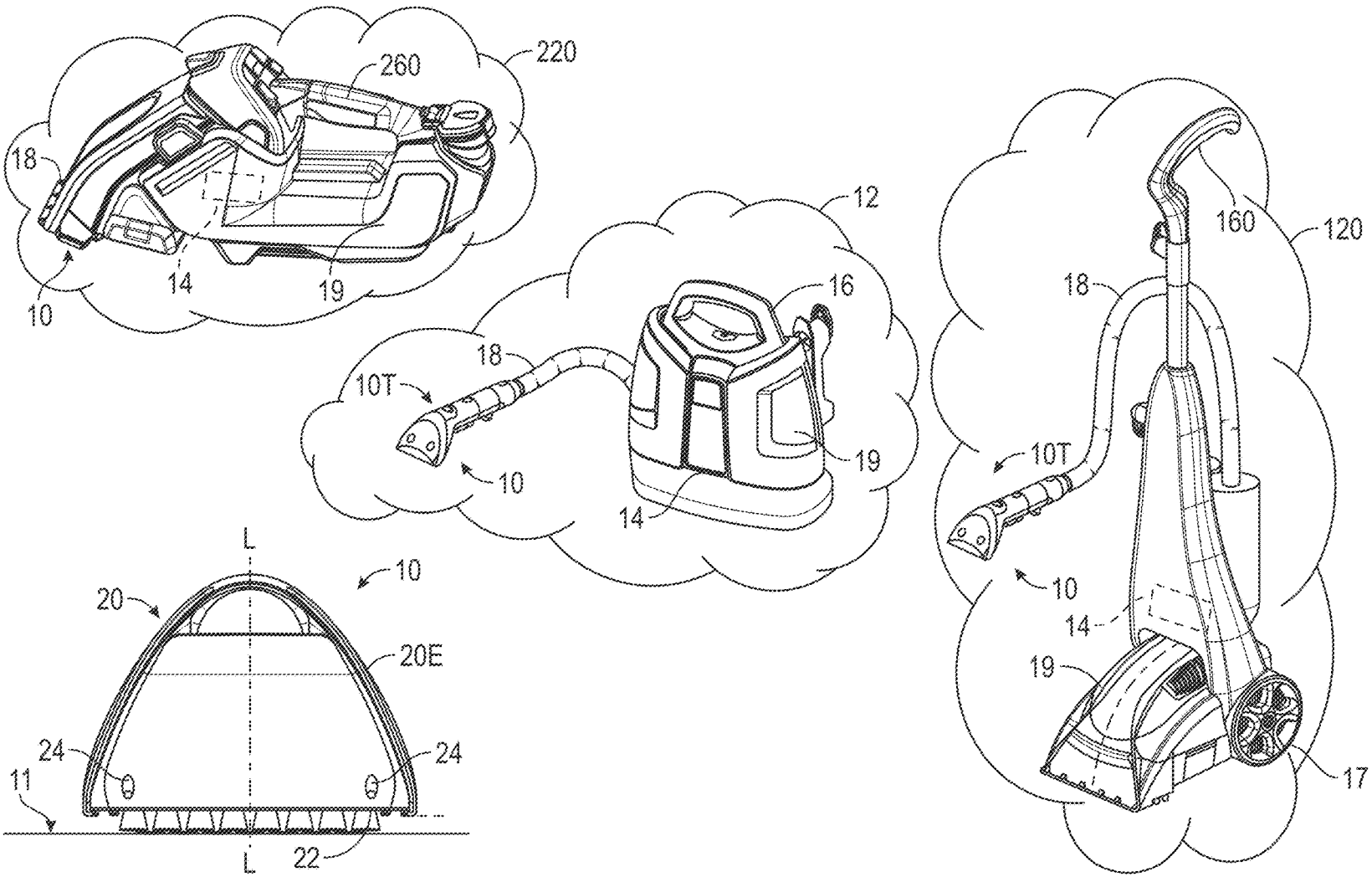
FIG. 1 is a front view illustration of a suction nozzle for use with a variety of extraction cleaners and equipped with air vents as described herein.

Referring to the drawings, wherein like reference numbers refer to the same or like components in the several Figures, a suction nozzle 10 is shown in FIG. 1 as being usable with a variety of extraction cleaners having a corresponding suction source 14 for cleaning a surface 11, e.g., upholstery or carpeting. In its different constructions, the suction nozzle 10 may be used as a hose-connectable attachment of a portable extraction cleaner 12. The portable extraction cleaner 12 in such a configuration typically includes a housing 19 and a handle 16 coupled therewith, i.e., connected to or integrally formed with the housing 19. Some constructions of the portable extraction cleaner 12 allow a user to lift and carry the portable extraction cleaner 12 in the process of cleaning the surface 11. A flexible length of hose 18 connects the suction nozzle 10 to the housing 19 and allows the user to maneuver the suction nozzle 10 with respect to the surface 11. In this way, the suction nozzle 10 may be carried as part of an accessory tool 10T coupled with the housing 19 by the hose 18 in some embodiments.

Alternatively, the suction nozzle 10 described herein may be used with or as part of an upright extraction cleaner 120 using a similar connection of the hose 18 to the housing 19. The upright extraction cleaner 120 may be connected to a set of wheels 17. The upright extraction cleaner 120 in this embodiment is movable along the surface 11 via the wheels 17, i.e., the user is able to roll the upright extraction cleaner 120 along the surface 11. While doing this, the same user could manipulate the upright extraction cleaner 120 via a handle 160 coupled with the housing 19.

In yet another embodiment, a handheld extraction cleaner 220 may be characterized by an absence of the aforementioned hose 18. Instead, the handheld extraction cleaner 220 may be coupled with a handle 260 as shown, with the suction nozzle 10 being adapted for use as a component of the handheld extraction cleaner 220. For instance, the modifications described hereinbelow may be incorporated into an existing nozzle construction to provide the handheld extraction cleaner 220 with the benefits of the present suction nozzle 10. Thus, the following teachings are not limited to a particular type of the depicted extraction cleaners 12, 120, or 220 or variations thereof.

Irrespective of the particular configuration of the extraction cleaner 12,120, or 220, the suction source 14 may be variously embodied as one or more vacuum pumps or motor/fan assemblies each fluidly connected to the suction nozzle 10, e.g., via internal hoses, fluid channels, or other conduit (not shown). Other internal structure of the extraction cleaners 12, 120, and 220 likewise omitted for illustrative simplicity and clarity typically include a fluid supply tank operable for storing a supply of cleaning fluid, a fluid recovery tank operable for collecting and temporarily storing extracted fluid and debris, and a possible centrifugal separator. Representative configurations can be found in U.S. Pat. No. 8,707,510 to Reed, Jr., U.S. Pat. No. 8,991,000 Huffman et al., and U.S. Pat. No. 9,867,517 to Krebs et al., which are hereby incorporated by reference in their respective entireties.

Within the scope of the present disclosure, the suction nozzle 10 as contemplated herein includes a tool body 20 having a suction inlet 22, with the suction inlet 22 arranged parallel to the surface 11 during an extraction process. When viewed from the front or rear, the tool body 20 may be generally hemispherical, trapezoidal, or triangular in different embodiments. Without wishing to be limited by any theory, it is believed that the latter shapes may have certain efficiency benefits in terms of reduced internal turbulence in some applications.

Additionally, the tool body 20 of the suction nozzle 10 in accordance with the disclosure defines a pair of air vents 24, e.g., an oppositely-disposed or symmetrical arrangement as shown. The air vents 24, which may be situated proximate respective lateral edges 20E of the tool body 20 at a predetermined distance or height above a plane P1 (see FIG. 2) of the suction inlet 22, are sized, oriented, positioned, and shaped, i.e., configured, to efficiently guide and carry extracted fluid and debris from the surface 11 to the hose 18 under the flow-restricted conditions common to deep cleaning of upholstery and other similar surfaces 11. Incorporation of the air vents 24 is therefore intended to improve recovery efficiency, as measured by recovery-per-stroke of the suction nozzle 10 relative to constructions lacking the air vents 24.

In general, the air vents 24 described herein, along with other optional features, help avoid the undesirable collection or internal buildup of extracted fluid within an extraction nozzle volume 32 (see FIGS. 3 and 5A) of the suction nozzle 10. This occurs by facilitating the ability of the extracted fluid and entrained debris to coalesce into a larger fluid stream. More specifically, the air vents 24 introduce predetermined air leaks and resulting slipstreams within the tool body 20 to improve internal flow properties, which may be of particular benefit when using the suction nozzle 10 on the above-noted upholstery or other similarly resilient or compliant surfaces 11. While two air vents 24 are described below for illustrative consistency, those skilled in the art will appreciate that more than two of the air vents 24 may be used in other constructions within the scope of the present disclosure. Exemplary suction nozzles 10 suitable for enabling such improvements will now be described with reference to the remaining Figures.

Figures 2, 2A:
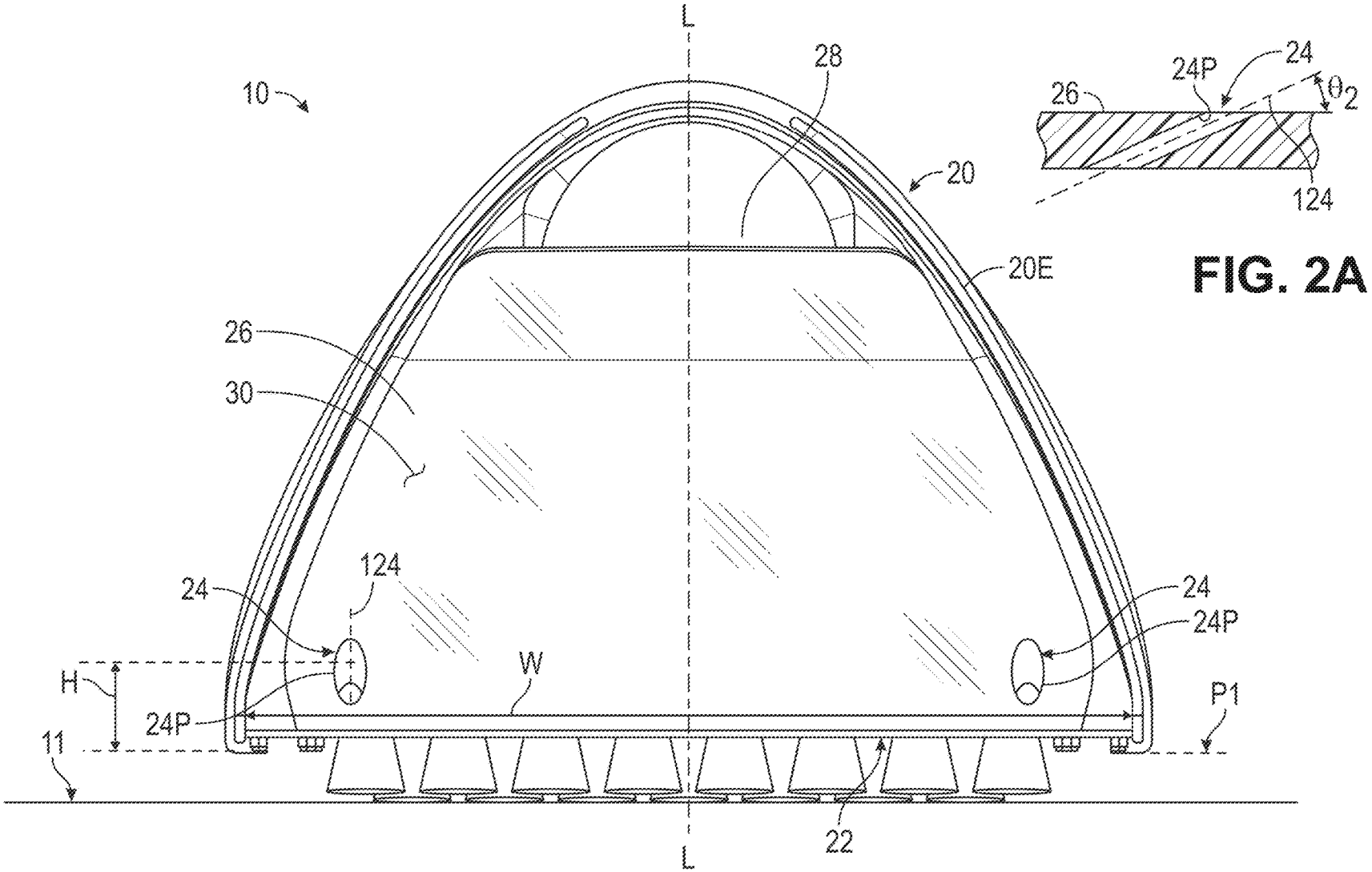
FIG. 2 is a front view illustration of a tool body having the suction nozzle shown in FIG. 1.
FIG. 2A is a cross-sectional illustration of a representative air vent showing its angular relationship with a rear wall of the suction nozzle.

Referring to FIG. 2, the tool body 20 of the suction nozzle 10 as contemplated herein is shown in front view according to an exemplary embodiment. The tool body 20 in this particular configuration includes a centerline LL. While the air vents 24 are described as being symmetrically located on the tool body 20, i.e., oppositely disposed and equidistant from the centerline LL of the tool body 20, it is understood that the relative location of each air vent 24 may be different such that the air vents 24 are asymmetrically located relative to such a centerline LL, i.e., with one air vent 24 possibly being closer to the centerline LL than the other. The tool body 20 also includes a rear wall 26 and an exhaust port 28, e.g., an opening configured to connect to the suction source 14 of FIG. 1 via the hose 18 of FIG. 1 or other suitable structure. A front cover 30 and the rear wall 26 together define the above-noted extraction nozzle volume 32 (see FIGS. 3 and 5A) having the suction inlet 22 arranged in the plane P1 as disclosed above, e.g., a rectangular or generally rectangular opening or another application suitable perimeter shape.

The suction inlet 22 in one or more exemplary embodiments may be a single opening extending along a width (W) of the suction nozzle 10, with the width (W) being about 3 inches to about 6 inches (76.2 mm to 152.4 mm) in different non-limiting representative constructions. As noted above, the suction inlet 22 may be constructed as multiple adjacent segments or sections within the scope of the disclosure to enhance structural integrity, e.g., by supporting the suction inlet 22 with one or more transverse ribs (not shown).

In accordance with the present disclosure and as noted generally hereinabove, the tool body 20 of the suction nozzle 10 depicted in FIGS. 2 and 5A defines the air vents 24. The air vents 24 in turn are situated at a height (H) above the suction inlet 22, e.g., above the plane P1. In a possible construction, the height (H) may be between about 0.75 inches to about 1.5 inches (19.05 mm to 38.1 mm) as measured from the suction inlet 22 to an intersection of a center axis 124 of each air vent 24 with a plane $P_{26}$ defined by the rear wall 26. Example dimensions within such ranges may include: within about 2 inches (50.8 mm), about 1.75 inches (44.45 mm), about 1.5 inches (38.1 mm), about 1.25 inches (31.75 mm), about 1 inch (25.4 mm), or about 0.75 inches (19.05 mm) of the suction inlet 22, as measured from the suction inlet 22 to a central axis of the air vent 24. In some aspects, the air vents 24 may be disposed within about 0.1 inches to about 2 inches (2.54 mm to 50.8 mm), about 0.1 inches to about 1.75 inches (2.54 mm to 44.45 mm), about inches to about 1.5 inches (2.54 mm to 38.1 mm), about 0.1 inches to about 1.25 inches (2.54 mm to 31.75 mm), about 0.1 inches to about 1 inch (2.54 mm to 25.4 mm), about 0.1 inches to about 0.75 inches (2.54 mm to 19.05 mm), about 0.1 inches to about inches (2.54 mm to 12.7 mm), about 0.25 inches to about 2 inches (6.35 mm to 50.8 mm), about 0.25 inches to about 1.75 inches (6.35 mm to 44.45 mm), about 0.25 inches to about 1.5 inches (6.35 mm to 38.1 mm), about 0.25 inches to about 1.25 inches (6.35 mm to 31.75 mm), about 0.25 inches to about 1 inch (6.35 mm to 25.4 mm), about 0.25 inches to about 0.75 inches (6.35 mm to 19.05 mm), about 0.25 inches to about 0.5 inches (6.35 mm to 12.7 mm), about 0.5 inches to about 2 inches (12.7 mm to 50.8 mm), about inches to about 1.75 inches (12.7 mm to 44.45 mm), about 0.5 inches to about 1.5 inches (12.7 mm to 38.1 mm), about 0.5 inches to about 1.25 inches (12.7 mm to 31.75 mm), about 0.5 inches to about 1 inch (12.7 mm to 25.4 mm), about 0.5 inches to about inches (12.7 mm to 19.05 mm), about 0.75 inches to about 2 inches (19.05 mm to mm), about 0.75 inches to about 1.75 inches (19.05 mm to 44.45 mm), about 0.75 inches to about 1.5 inches (19.05 mm to 38.1 mm), about 0.75 inches to about 1.25 inches (19.05 mm to 31.75 mm), about 0.75 inches to about 1 inch (19.05 mm to 25.4 mm), about 1 inch to about 2 inches (25.4 mm to 50.8 mm), about 1 inch to about 1.75 inches (25.4 mm to 44.45 mm), about 1 inch to about 1.5 inches (25.4 mm to 38.1 mm), about 1 inch to about 1.25 inches (25.4 mm to 31.75 mm), about 1.25 inches to about 2 inches (31.75 mm to 50.8 mm), about 1.25 inches to about 1.75 inches (31.75 mm to 44.45 mm), about 1.25 inches to about 1.5 inches (31.75 mm to 38.1 mm), about 1.5 inches to about 2 inches (38.1 mm to 50.8 mm), or about 1.5 inches to about 1.75 (38.1 mm to 44.45 mm), as measured from the suction inlet 22 to a central axis of the air vent 24.

As recognized herein, placement of the air vents 24 too far above the suction inlet 22 may result in creation of an internal wall of air, which in turn could render the air vents 24 counterproductive for the purposes envisioned herein. Thus, the exemplary range for the height (H) has a corresponding advantageous effect on the resulting fluid dynamics properties of the suction nozzle 10.

Still referring to FIG. 2, the rear wall 26 is connected to or integrally formed with the lateral edges 20E, noted briefly above. Each of the air vents 24 may be positioned within about 0.4 inches to about 0.8 inches (10.16 mm to 20.32 mm), or less than about 1 inch (25.4 mm), of a respective one of the lateral edges 20E in a possible construction. Non-limiting example dimensional ranges within the scope of the disclosure are as follows. The air vents 24 may be disposed within about 1 inch (25.4 mm), about 0.9 inches (22.86 mm), about 0.8 inches (20.32 mm), about 0.7 inches (17.78 mm), about 0.6 inches (15.24 mm), about 0.5 inches (12.7 mm), or about 0.4 inches (10.16 mm) from the lateral edges 20E, as measured from the lateral edge 20E to the nearest edge of the air vents 24. In some aspects, the nearest edge of the air vents 24 may be disposed relative to the nearest lateral edge 20E, within about 0.1 inches to about 1 inch (2.54 mm to 25.4 mm), about 0.1 inches to about 0.8 inches (2.54 mm to 20.32 mm), about 0.1 inches to about inches (2.54 mm to 17.78 mm), about 0.1 inches to about 0.6 inches (2.54 mm to 15.24 mm), about 0.1 inches to about 0.5 inches (2.54 mm to 12.7 mm), about 0.1 inches to about 0.4 inches (2.54 mm to 10.16 mm), about 0.2 inches to about 1 inch (5.08 mm to mm), about 0.2 inches to about 0.8 inches (5.08 mm to 20.32 mm), about 0.2 inches to about 0.7 inches (5.08 mm to 17.78 mm), about 0.2 inches to about 0.6 inches (5.08 mm to 15.24 mm), about 0.2 inches to about 0.5 inches (5.08 mm to 12.7 mm), about 0.2 inches to about 0.4 inches (5.08 mm to 10.16 mm), about 0.3 inches to about 1 inch (7.62 mm to 25.4 mm), about 0.3 inches to about 0.8 inches (7.62 mm to 20.32 mm), about 0.3 inches to about 0.7 inches (7.62 mm to 17.78 mm), about 0.3 inches to about 0.6 inches (7.62 mm to 15.24 mm), about 0.3 inches to about 0.5 inches (7.62 mm to 12.7 mm), about 0.3 inches to about 0.4 inches (7.62 mm to 10.16 mm), about 0.4 inches to about 1 inch (10.16 mm to 25.4 mm), about 0.4 inches to about 0.8 inches (10.16 mm to 20.32 mm), about 0.4 inches to about 0.7 inches (10.16 mm to 17.78 mm), about 0.4 inches to about 0.6 inches (10.16 mm to 15.24 mm), about 0.4 inches to about 0.5 inches (10.16 mm to 12.7 mm), about 0.5 inches to about 1 inch (12.7 mm to 25.4 mm), about 0.5 inches to about 0.8 inches (12.7 mm to 20.32 mm), about 0.5 inches to about 0.7 inches (12.7 mm to 17.78 mm), or about 0.5 inches to about 0.6 inches (12.7 mm to 15.24 mm).

A respective outer perimeter 24P of each of the air vents 24 at an interface with body 20, in this case the rear wall 26, has a generally ovoid shape or tapered shape as shown. This is due to the fact that the rear wall 26 is disposed at an angle relative to the surface 11, i.e., the rear wall 26 tilts backward toward the user from the perspective of FIG. 2. The rearward tilt of the rear wall 26 is such that the rear wall 26 is disposed at a first angle ($\theta_1$) relative to the surface 11 to be deep-cleaned using the suction nozzle 10, as best shown in FIG. 5A and described below.

Figure 5A:
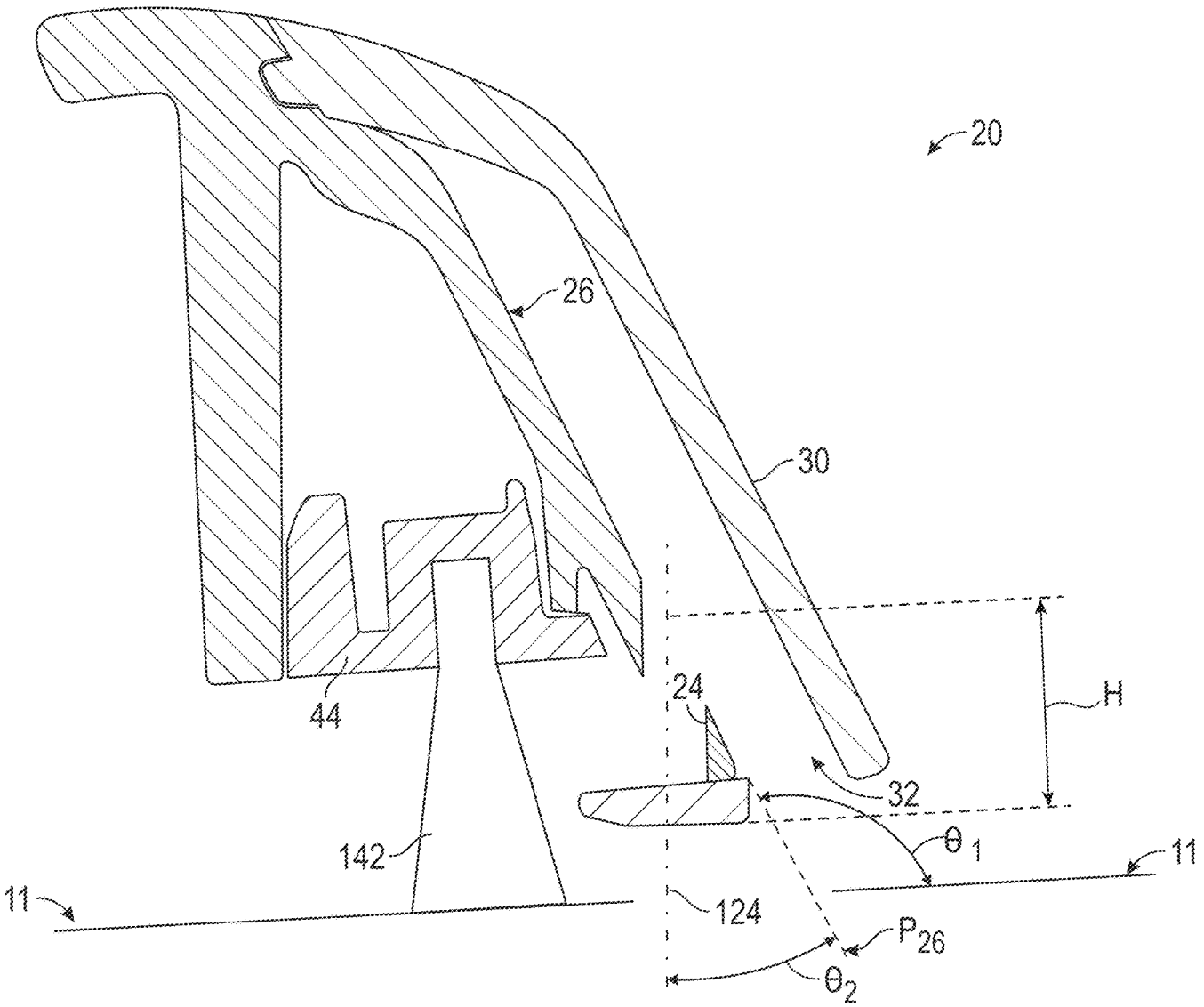
FIG. 5A is a cross-sectional view illustration of the suction nozzle of FIG. 4 taken along cut line A-A thereof.

Referring briefly to FIG. 2A, the air vents 24 each have respective center axes 124 arranged at a second angle ($\theta_2$) relative to the plane $P_{26}$ defined by the rear wall 26, with the second angle ($\theta_2$) also shown in FIG. 5A. The respective center axes 124 of the air vents 24 thus intersect the rear wall 26 at a non-orthogonal angle ($\theta_2$). According to one aspect, the air vents 24 intersect the rear wall 26 at a non-orthogonal second angle ($\theta_2$) that is less than 90 degrees, relative to the plane $P_{26}$. For example, the air vents 24 can intersect the rear wall 26 at a non-orthogonal second angle ($\theta_2$) that is less than 90 degrees, less than 80 degrees, less than 70 degrees, less than 60 degrees, less than 50 degrees, less than 40 degrees, or less than 30 degrees relative to the plane $P_{26}$. In some aspects, the air vents 24 intersect the rear wall 26 at a non-orthogonal second angle ($\theta_2$) that is from about 20 degrees to about 80 degrees, about 30 degrees to about 80 degrees, about 40 degrees to about 80 degrees, about 50 degrees to about 80 degrees, about 60 degrees to about 80 degrees, about 70 degrees to about 80 degrees, about 20 degrees to about 70 degrees, about 30 degrees to about 70 degrees, about 40 degrees to about 70 degrees, about 50 degrees to about 70 degrees, about 60 degrees to about 70 degrees, about 20 degrees to about 60 degrees, about 30 degrees to about 60 degrees, about 40 degrees to about 60 degrees, about 50 degrees to about 60 degrees, about 20 degrees to about 50 degrees, about 30 degrees to about 50 degrees, about 40 degrees to about 50 degrees, about 20 degrees to about 40 degrees, or about 30 degrees to about 40 degrees, relative to the plane $P_{26}$. In one exemplary orientation, the center axes 124 of the air vents 24 are arranged at a second angle ($\theta_2$) that is within about 25 degrees, about 30 degrees, about 35 degrees, about 40 degrees, or about 45 degrees, relative to the plane P26. For example, the air vents 24 can intersect the rear wall 26 at a non-orthogonal second angle ($\theta_2$) that is from about 30 degrees to about 45 degrees, relative to the plane $P_{26}$.

While such angles are representative and non-limiting, the air vents 24 do not penetrate the rear wall 26 at or near 90° and thus are substantially non-orthogonal to the rear wall 26. A benefit of the aforementioned non-orthogonal angular possibilities of the center axes 124 is that airflow admitted through the air vents 24 gradually merges with the captive air and extracted cleaning fluids in the extraction nozzle volume 32, thereby reducing fluid turbulence within the extraction nozzle volume 32 while enabling the air vents 24 to perform their desired coalescing enhancement functions. Additional aspects of internal flow characteristics are set forth below with particular reference to FIG. 6.

Figure 3:
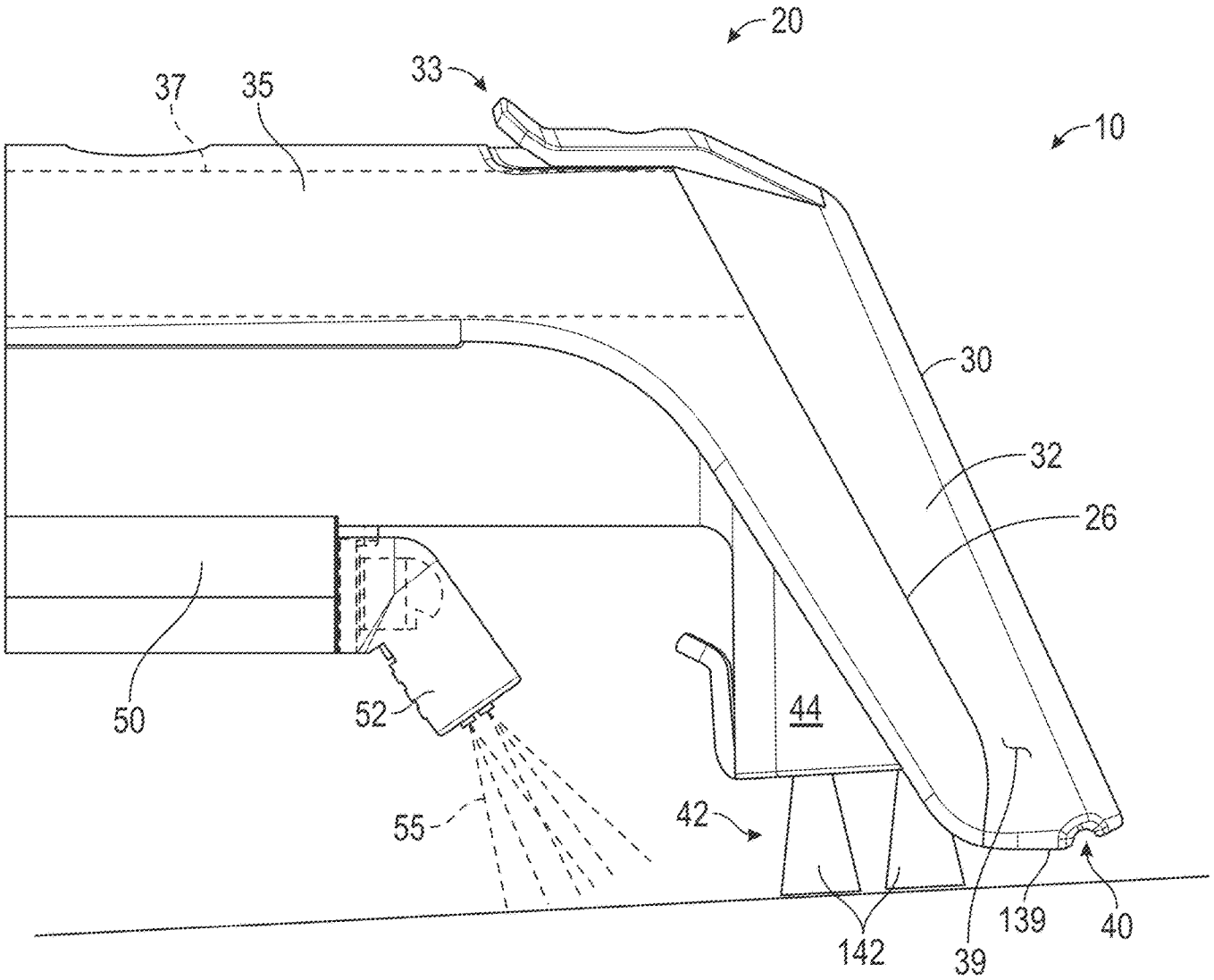
FIG. 3 is a side view illustration of the suction nozzle of FIGS. 1 and 2 according to a construction in which the suction nozzle is equipped with an optional agitator assembly.

With respect to functionality of the suction nozzle 10, FIG. 3 illustrates a possible removable construction of the front cover 30. In this particular implementation, the tool body 20 includes a conduit 35 defining therein a fluid passage 37 in fluid communication with the exhaust port 28 (also see FIG. 2), and thus with the suction source 14 and recovery tank (not shown) described above. The conduit 35 is configured to connect to the extraction cleaners 12 or 120 of FIG. 1, e.g., via a hose clamp or push-to-connect fitting as appreciated in the art. An optional latching mechanism 33 operable for securing the front cover 30 to the rear wall 26 may be depressed or actuated in some implementations to release the front cover 30 from the rear wall 26, which in turn allows the front cover 30 to be removed for cleaning. Other approaches may be visualized within the scope of the disclosure, including perimeter snap-fit connections, and therefore the latching mechanism 33 is just one possible solution for removably securing the front cover 30.

Figure 5B:
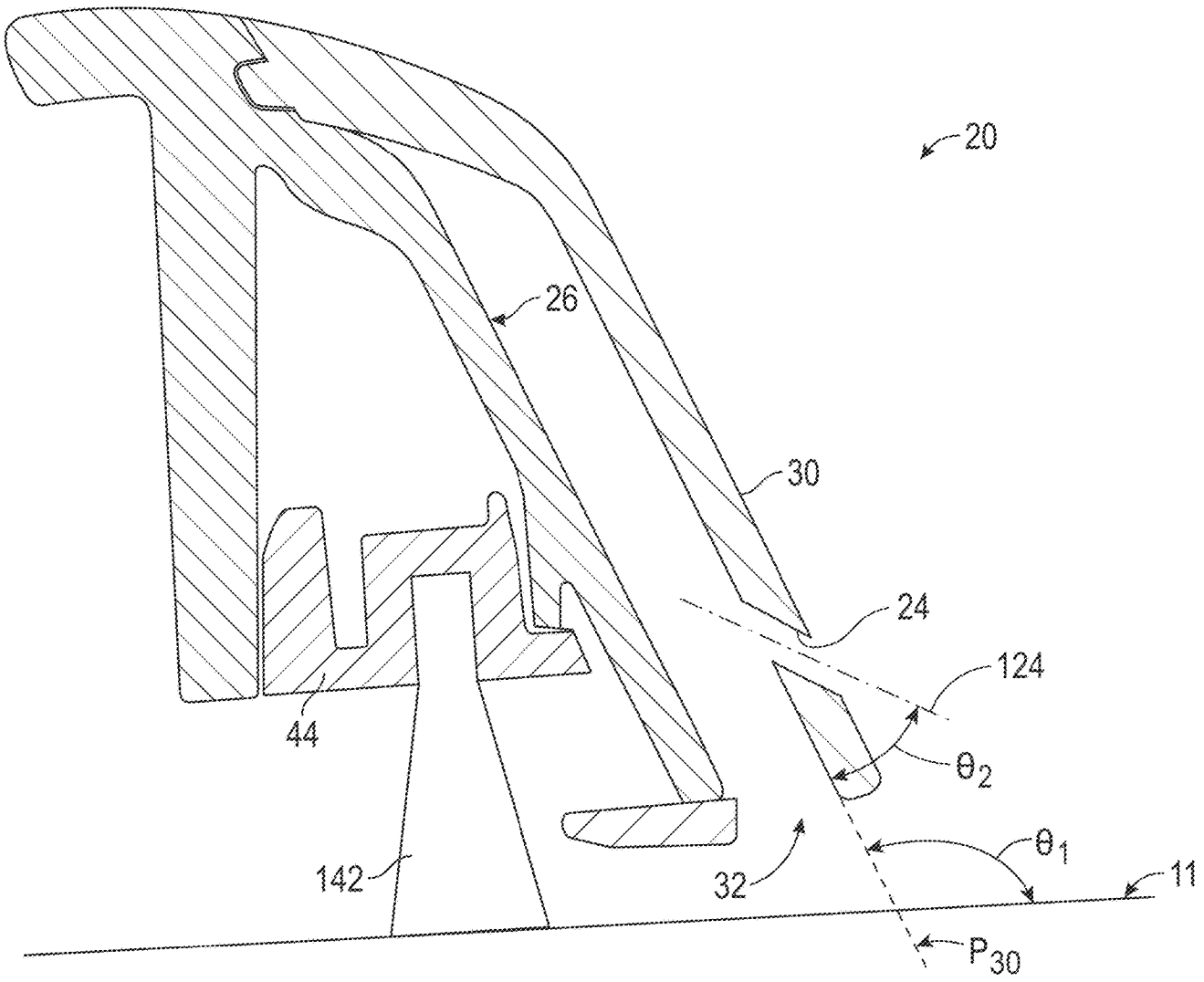
FIG. 5B is a cross-sectional view illustration of a suction nozzle with air vents defined in a front cover.

In a possible construction, the front cover 30 may be formed at least in part from a transparent material such as clear or tinted/smoked plastic when the air vents 24 are formed in the rear wall 26, thus allowing the front cover 30 to function as a lens. From a user standpoint, construction of the front cover 30 as a transparent lens provides various benefits and advantages, including allowing the user to see the extracted cleaning fluid being removed from the surface 11 and suctioned away through the exhaust port 28. This in turn may reassure the user that the extraction cleaning process is working, i.e., that the extraction flow remains strong and unimpeded. In some aspects, the front cover 30 may be formed at least in part by an opaque material. While the air vents 24 are described above in the context of being formed in the rear wall 26, it is within the scope of the disclosure for the air vents 24 to be formed in a similar manner in the front cover 30. When the air vents 24 are formed in the front cover 30, as shown in FIG. 5B, the respective center axes 124 of the air vents 24 intersect the front cover 30 at a non-orthogonal angle with respect to a plane $P_{30}$ defined by an adjacent surface of the front cover 30 in a manner similar to that which is described herein with respect to the second angle ($\theta_2$) and the plane $P_{26}$ defined by the rear wall 26. The front cover 30 may have a rearward tilt such that the front cover 30 is disposed at the first angle ($\theta_1$) relative to the surface 11 in a manner similar to that which is described herein with respect to the rear wall 26.

As depicted in FIG. 3 the suction nozzle 10 described herein may also include an optional dispenser nozzle 50. When activated, e.g., using a spray tip 52 or a trigger mechanism (not shown), cleaning fluid 55 is expelled from the dispenser nozzle 50 and spray tip 52 onto the surface 11. The user may thereafter work the applied cleaning fluid into the surface 11, with the particular composition of the cleaning fluid 55 varying with the particular application, e.g., as a water-based cleaning solution. To that end, in some constructions the suction nozzle 10 could be equipped with an optional agitator assembly 42 disposed adjacent to the suction inlet 22 and attached to a support block 44 of the tool body 20, for instance a molded plastic block or other suitable mounting structure for retaining the agitator assembly 42.

Although in the illustrated non-limiting embodiment of FIG. 3 the cleaning fluid 55 is dispensed via the dispenser nozzle 50, in other constructions the cleaning fluid may be dispensed through the agitator assembly 42 itself, in which case individual brushes, needles, or other projections 142 could be equipped with internal fluid passages (not shown) and thus constructed as fluid nozzles. In the various constructions, the user could thereafter agitate the dispensed cleaning fluid 55 using a back-and-forth scrubbing motion of the agitator assembly 42 to extract embedded dirt and debris as summarized above.

As best shown in FIG. 3, the front cover 30 may include a pair of side walls 39, i.e., the lateral walls or flanks of the front cover 30 when viewed from the front as in FIGS. 1 and 2. In one or more embodiments, a lower edge 139 of the side walls 39 adjacent to suction inlet 22 optionally defines an arcuate notch 40. The opposing arcuate notches 40 together may be used to further improve suction airflow, particularly when the introduced suction from the suction source 14 of FIG. 1 has ingested a portion of the surface 11 into the extraction nozzle volume 32. The arcuate notches 40 thereby form side vents which introduce airflow into the extraction nozzle volume 32 proximate the suction inlet 22 of FIG. 2 to further improve fluid dynamics within the extraction nozzle volume 32 in another beneficial way. Combined, the arcuate notches 40 and the air vents 24 described above optimize flow fields and cleaning efficiency of the suction nozzle 10.

Figure 4:
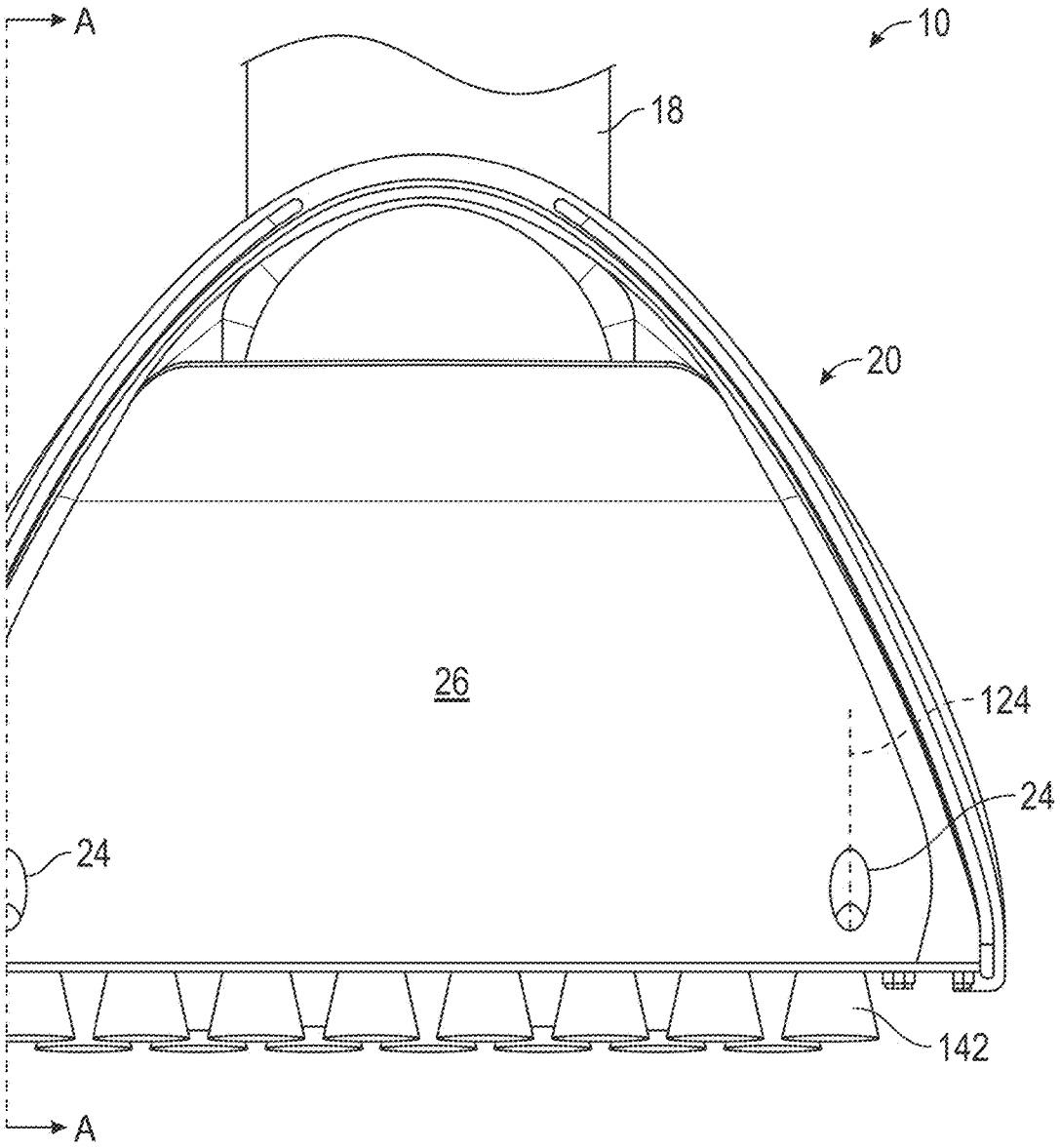
FIG. 4 is a partial front view illustration of the suction nozzle shown in FIGS. 1-3.

Referring briefly to the tool body 20 of FIGS. 4 and 5A, the suction nozzle 10 of FIG. 4 is shown with cut line A-A passing along the center axis 124 of one of the air vents 24. FIG. 5A shows the angular orientation of FIG. 2A from another perspective, i.e., with a representative one of the air vents 24, or more precisely its center axis 124, arranged at a non-orthogonal angle with respect to the plane $P_{26}$ defined by the rear wall 26. Thus, admitted airflow into the air vents 24 gradually blends with extraction flow that is already present within the extraction nozzle volume 32 defined between the front cover 30 and the rear wall 26, thereby reducing fluid turbulence within the extraction nozzle volume 32 while at the same time enabling the air vents 24 to perform their desired coalescing enhancing functions as noted above with reference to FIG. 2A.

Figure 6:
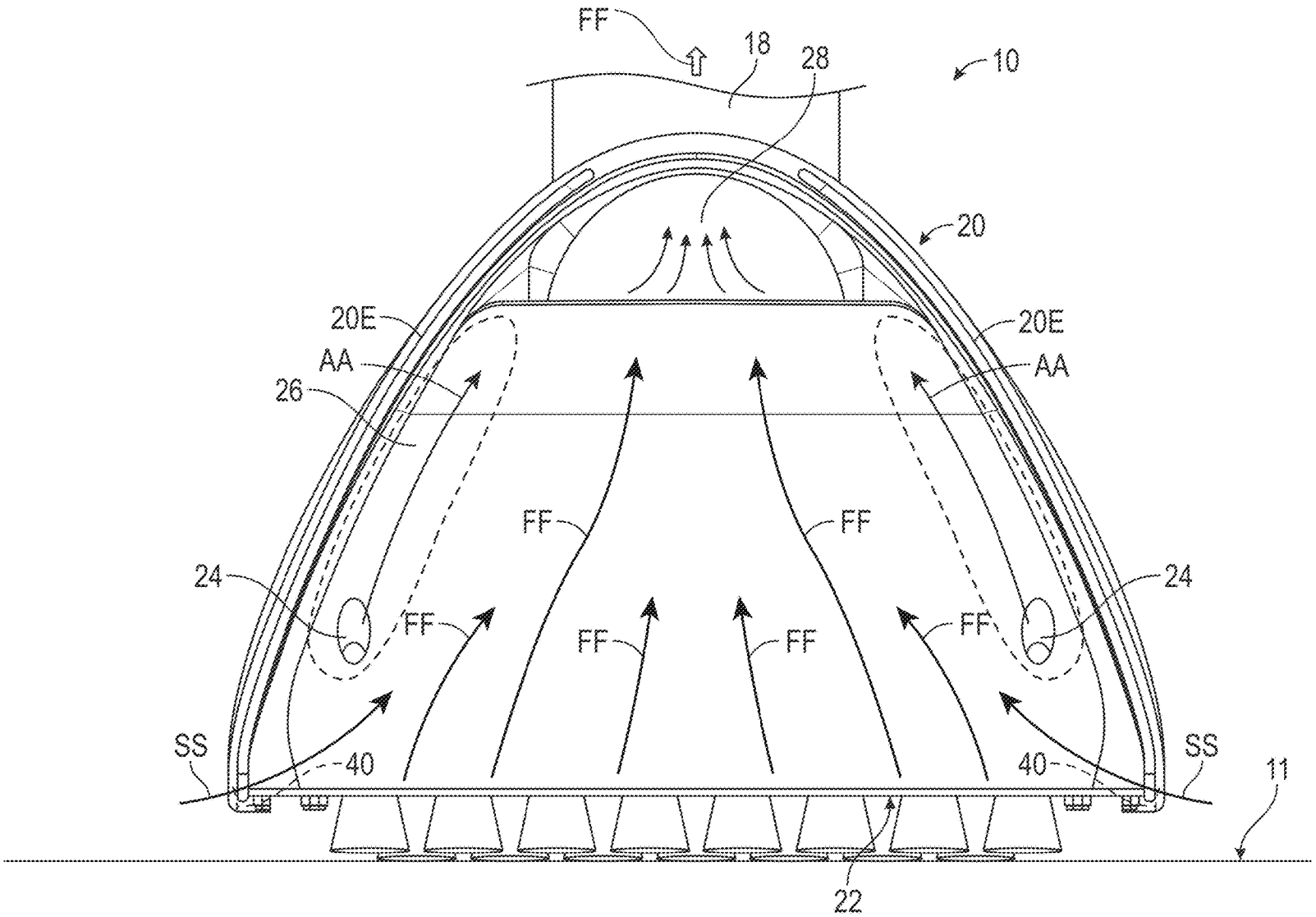
FIG. 6 is a front view illustration of the suction nozzle of FIGS. 1-4 showing representative internal flow fields.

In operation, the suction nozzle 10, as shown in FIG. 6, is moved relative to the surface 11 by the user. As this occurs, the suction source 14, shown schematically in FIG. 1, provides a vacuum sufficient for extracting cleaning fluid and entrained debris from the surface 11. At the same time, the air vents 24 in the tool body 20, and in particular the rear wall 26 in the illustrated representative embodiments, admit a venting airflow (arrows AA) into the extraction nozzle volume 32 of FIGS. 3 and 5A. The venting airflow (arrows AA) admitted by the air vents 24 contribute to facilitating the coalescence of the extracted cleaning fluid (and entrained debris) within the extraction nozzle volume 32 toward the exhaust port 28, as represented by arrows FF of FIG. 6. Absent the air vents 24, the extracted cleaning fluids would tend to break up and disperse, and to thereafter collect within the extraction nozzle volume 32 (which may visually appear to a consumer as "swirling") for a longer period of time before exiting the suction nozzle through the exhaust port 28, compared to a tool having the air vents 24. Without intending to be limited by any particular theory, the air vents 24 are believed to contribute to increasing air velocity near the lateral edges of the suction nozzle, which may facilitate a reduction in accumulation of debris near the lateral edges of the suction nozzle, which can lead to a more efficient removal of liquid and entrained debris from within the extraction nozzle volume 32, and thus the surface. In addition, during use, a user may press the suction nozzle 10 against the surface 11 such that the suction nozzle inlet 22 is in a sealed or partially sealed condition with the surface 11. In the absence of the air vents 24, the airflow through the tool can decrease in this condition, resulting in a decrease in the extraction efficiency of the tool, which is undesirable to a user. The air vents 24 of the present disclosure allow for airflow to continue to move through the extraction nozzle volume 32 in this type of sealed or partially sealed condition, which allows for a higher extraction efficiency (compared to a tool without the air vents 24), and thus provides the user with a more desirable cleaning experience. In some embodiments in which the arcuate notches 40 (FIG. 3) are also present, the arcuate notches 40 introduce a slipstream airflow (arrows SS) proximate the suction inlet 22 to further improve fluid dynamics as noted above, with the venting airflow (arrows AA) and the slipstream airflow (arrows SS) ultimately facilitating the coalescence of the extracted cleaning fluid within the extraction nozzle volume 32, as represented by arrows FF of FIG. 6.

The various structural modifications described herein therefore solve the potential problem of suboptimal extraction flow and lower than desired cleaning efficiency in two ways: (1) by introducing the venting airflow (arrows AA) at a specific location to, in conjunction with the slipstream airflow (arrows SS), cause the extracted fluid and entrained debris to coalesce into a larger and more centrally disposed fluid extraction stream, thereby preventing damming of the cleaning fluids near the suction inlet 22 and collection of the same along the lateral edges 20E of the tool body 20, and (2) by introducing slipstream airflow (arrows SS) via the above-described side notches 40. These and other potential benefits will be readily appreciated by those skilled in the art in view of the foregoing disclosure and supporting Figures.

The following Clauses provide some representative configurations of tool bodies for use with extraction tools and extraction cleaners using such tools as disclosed herein.

Clause 1: A suction nozzle for use with an extraction cleaner having a suction source, comprising: a tool body having a rear wall, wherein the tool body defines an exhaust port configured to connect to said suction source; and a front cover connected to the tool body, wherein the front cover and the rear wall together define an extraction nozzle volume having a suction inlet, and wherein the rear wall or the front cover defines an oppositely-disposed pair of air vents situated at a height above the suction inlet.

Clause 2: The suction nozzle of clause 1, wherein a center axis of each of the oppositely disposed pair of air vents intersect the rear wall at a non-orthogonal angle.

Clause 3: The suction nozzle of clauses 1 or 2, wherein the air vents are formed in the rear wall.

Clause 4: The suction nozzle of any of clauses 1-3, further comprising a latching mechanism operable for securing the front cover to the rear wall.

Clause 5: The suction nozzle of any of clauses 1-4, wherein a respective perimeter of each of the air vents at an interface with the tool body has an ovoid shape or a tapered shape.

Clause 6: The suction nozzle of any of clauses 1-5, wherein the front cover has a pair of side walls, and wherein a lower edge of each side wall of the pair of side walls is adjacent to the suction inlet and defines an arcuate notch.

Clause 7: The suction nozzle of any of clauses 1-6, wherein the height above the suction inlet is about 2 inches or less.

Clause 8: The suction nozzle of any of clauses 1-7, wherein the tool body includes lateral edges, and wherein each of the air vents is positioned about 1 inch or less from a respective one of the lateral edges.

Clause 9: The suction nozzle of any of clauses 1-8, further comprising an agitator assembly disposed adjacent to the suction inlet.

Clause 10: The suction nozzle of any of clauses 1-9, further comprising a conduit defining a fluid passage therein, the fluid passage in fluid communication with the exhaust port, wherein the conduit is configured to connect to said extraction cleaner.

Clause 11: An extraction cleaner comprising: a housing; a suction source connected to the housing; and a suction nozzle comprising: a tool body having a rear wall; an exhaust port defined by the tool body, wherein the exhaust port is connected to the suction source; and a front cover connected to the rear wall such that the front cover and the rear wall together define an extraction nozzle volume having a suction inlet, wherein the rear wall defines an oppositely-disposed pair of air vents situated at a height above the suction inlet, each respective one of the air vents having a respective center axis that intersects the rear wall at a non-orthogonal angle.

Clause 12: The extraction cleaner of clause 11, wherein the suction nozzle is carried by a tool coupled with the by a hose.

Clause 13: The extraction cleaner of clause 11, wherein the housing comprises a handle and the suction nozzle is coupled with the housing.

Clause 14: The extraction cleaner of clauses 11 or 12, further comprising a set of wheels connected to the housing, wherein said extraction cleaner is movable along a surface via the set of wheels, and wherein the suction nozzle is coupled with the housing.

Clause 15: The extraction cleaner of any of clauses 11-14, wherein the front cover has a pair of side walls, and wherein a lower edge of each side wall of the pair of side walls is adjacent to the suction inlet and defines an arcuate notch.

Clause 16: The extraction cleaner of any of clauses 11-15, further comprising a conduit defining therein a fluid passage in fluid communication with the exhaust port, wherein the conduit is configured to connect to said extraction cleaner.

Clause 17: A suction nozzle for use with an extraction cleaner having a suction source, comprising: a tool body having a rear wall; an exhaust port defined by the tool body, wherein the exhaust port is configured to connect to said suction source; an agitator assembly; and a front cover connected to the tool body and having a pair of side walls, wherein a lower edge of each side wall of the pair of side walls defines an arcuate notch, and wherein: the front cover and the rear wall together define an extraction nozzle volume having a suction inlet, wherein the agitator assembly is disposed adjacent to the suction inlet; the arcuate notch is configured to admit a slipstream into the extraction nozzle volume; and the rear wall defines a pair of air vents having respective center axes that intersect the rear wall at a non-orthogonal angle.

Clause 18: The suction nozzle of clause 17, wherein the tool body includes lateral edges, and wherein each air vent of the pair of air vents is positioned about 1 inch or less from a respective one of the lateral edges.

Clause 19: The suction nozzle of clauses 17 or 18, further comprising a conduit defining a fluid passage therein, the fluid passage in fluid communication with the exhaust port, wherein the conduit is configured to connect to said extraction cleaner.

Clause 20: The suction nozzle of any of clauses 17-19, wherein the pair of air vents are situated less than about 2 inches above the suction inlet.

While some of the best modes have been described in detail, various alternative designs may exist for practicing the present teachings defined in the appended claims. Those skilled in the art will recognize that modifications may be made to the disclosed embodiments without departing from the scope of the subject disclosure. Moreover, the present concepts expressly include combinations and sub-combinations of the described elements and features. The detailed description and the drawings are supportive and descriptive of the present teachings, with the scope of the present teachings defined solely by the claims.

What is claimed is:

1. A suction nozzle for use with an extraction cleaner having a suction source, comprising:

a tool body having a rear wall, wherein the tool body defines an exhaust port configured to connect to said suction source; and a front cover connected to the tool body, wherein the front cover and the rear wall together define an extraction nozzle volume having a suction inlet, and wherein the rear wall or the front cover defines an oppositely-disposed pair of air vents situated at a height above the suction inlet, wherein the air vents are formed in the rear wall, and wherein a center axis of each of the oppositely-disposed pair of air vents intersect the rear wall at a non-orthogonal angle.

2. The suction nozzle of claim 1, further comprising:

a latching mechanism operable for securing the front cover to the rear wall.

3. The suction nozzle of claim 1, wherein a respective perimeter of each of the air vents at an interface with the tool body has an ovoid shape or a tapered shape.

4. The suction nozzle of claim 1, wherein the front cover has a pair of side walls, and wherein a lower edge of each side wall of the pair of side walls is adjacent to the suction inlet and defines an arcuate notch.

5. The suction nozzle of claim 1, wherein the height above the suction inlet is about 2 inches or less.

6. The suction nozzle of claim 1, wherein the tool body includes lateral edges, and wherein each of the air vents is positioned about 1 inch or less from a respective one of the lateral edges.

7. The suction nozzle of claim 1, further comprising:

an agitator assembly disposed adjacent to the suction inlet.

8. The suction nozzle of claim 1, further comprising:

a conduit defining a fluid passage therein, the fluid passage in fluid communication with the exhaust port, wherein the conduit is configured to connect to said extraction cleaner.

9. A suction nozzle for use with an extraction cleaner having a suction source, comprising:

a tool body having a rear wall;

an exhaust port defined by the tool body, wherein the exhaust port is configured to connect to said suction source;

an agitator assembly; and a front cover connected to the tool body and having a pair of side walls, wherein a lower edge of each side wall of the pair of side walls defines an arcuate notch, and wherein:

the front cover and the rear wall together define an extraction nozzle volume having a suction inlet, wherein the agitator assembly is disposed adjacent to the suction inlet;

the arcuate notch is configured to admit a slipstream into the extraction nozzle volume; and the rear wall defines a pair of air vents having respective center axes that intersect the rear wall at a non-orthogonal angle.

10. The suction nozzle of claim 9, wherein the tool body includes lateral edges, and wherein each air vent of the pair of air vents is positioned about 1 inch or less from a respective one of the lateral edges.

11. The suction nozzle of claim 9, further comprising:

a conduit defining a fluid passage therein, the fluid passage in fluid communication with the exhaust port, wherein the conduit is configured to connect to said extraction cleaner.

12. The suction nozzle of claim 9, wherein the pair of air vents are situated less than about 2 inches above the suction inlet.

13. An extraction cleaner comprising:

a housing;

a suction source connected to the housing; and a suction nozzle comprising:

a tool body having a rear wall;

an exhaust port defined by the tool body, wherein the exhaust port is connected to the suction source; and a front cover connected to the rear wall such that the front cover and the rear wall together define an extraction nozzle volume having a suction inlet, wherein the rear wall defines an oppositely-disposed pair of air vents situated at a height above the suction inlet, each respective one of the air vents having a respective center axis that intersects the rear wall at a non-orthogonal angle.

14. The extraction cleaner of claim 13, wherein the suction nozzle is carried by a tool coupled with the housing by a hose.

15. The extraction cleaner of claim 13, wherein the housing comprises a handle and the suction nozzle is coupled with the housing.

16. The extraction cleaner of claim 13, further comprising:

a set of wheels connected to the housing, wherein said extraction cleaner is movable along a surface via the set of wheels, and wherein the suction nozzle is coupled with the housing.

17. The extraction cleaner of claim 13, wherein the front cover has a pair of side walls, and wherein a lower edge of each side wall of the pair of side walls is adjacent to the suction inlet and defines an arcuate notch.

18. The extraction cleaner of claim 13, further comprising:

a conduit defining therein a fluid passage in fluid communication with the exhaust port, wherein the conduit is configured to connect to said extraction cleaner.

* * * * *